United States Patent [19]

Takahashi

[11] Patent Number: 4,668,544

[45] Date of Patent: May 26, 1987

[54] MULTI-LAYERED HOLLOW COIL, AND AN APPARATUS AND METHOD OF MANUFACTURING THEREOF

[75] Inventor: Teruo Takahashi, Niihama, Japan

[73] Assignee: Hakuto Seisakusho Co., Ltd., Niihama, Japan

[21] Appl. No.: 796,395

[22] Filed: Nov. 8, 1985

[30] Foreign Application Priority Data

Nov. 9, 1984 [JP] Japan ..... 59-236992

[51] Int. Cl.[4] ..... B21D 39/00; H01B 13/00; B65H 81/00

[52] U.S. Cl. ..... 428/593; 428/35; 428/36; 242/7.03; 29/605; 156/173; 156/175

[58] Field of Search ..... 428/35, 36, 593; 156/173, 175; 242/7.3; 29/605

[56] References Cited

U.S. PATENT DOCUMENTS 4,235,656 11/1980 Shimada et al. ..... 156/175
4,336,475 6/1982 Morinaga et al. ..... 310/198
4,355,459 10/1982 Takahashi et al. .
4,496,927 1/1985 Inoue ..... 336/208

FOREIGN PATENT DOCUMENTS 2048137 12/1980 United Kingdom .

*Primary Examiner*—John E. Kittle
*Assistant Examiner*—Patrick J. Ryan
*Attorney, Agent, or Firm*—Fleit, Jacobson, Cohn & Price

[57] ABSTRACT

Multi-layered hollow coil and apparatus and method of manufacturing thereof disclosed which includes a first regularly wound first portion of a coil due to a wire from a wire source by rotation of a coil metrix on a rotatable axle and subsequently spirally wound second portion due to a wire accumulated on a winding roller by reverse rotation of the coil matrix which is disposed between two flanges. In the first wound portion of multi-layers, layers in odd numbers are wound N times and other layers in even numbers are wound N−1 times, and the layers excepted a first layers are wound between crests of windings of the lower layer. The first wound portion is pressed between the flanges by a movable flange thereof and electrically melt. After united the first wound portion, the coil matrix is reversely rotated and the second wound portion is spirally wound adjacent to a side surface of the first wound portion, and both portions are pressed by the flanges and melt with one body of the coil which is removed from the coil matrix.

8 Claims, 10 Drawing Figures

MULTI-LAYERED HOLLOW COIL, AND AN APPARATUS AND METHOD OF MANUFACTURING THEREOF

BACKGROUND OF THE INVENTION

This invention relates to an improvement of a multi-layered hollow coil of a self-melting wire, and an apparatus and method of manufacturing thereof of the Japanese patent Application Nos. 208299/81 (the application laid open No. 108937/83) and 187148/84 assigned to the assignee and more particularly to a hollow coil having multi-layered windings for use in a rotatable electric equipment having no iron core, and an apparatus and method of manufacturing the coil by two winding operations due to a reversible coil matrix.

In past, U.S. Pat. No. 4,355,459 to Teruo Takahashi et al and UK Patent No. 2048137 B disclose an apparatus and method of coiling a wire in a rotatable tube. And, in the above stated Japanese patent application laid open No. 108937/83, a multi-layered hollow coil and a method of manufacturing thereof are disclosed, in which a wire is wound on a core disposed between spool-type flanges to place both first and last ends of the first layer in opposite portions adjacent to the flanges and to wind second layer between respective crests of the windings of the first layer, and the layers are repeated to place the layers in odd numbers on the same situation of the first layer and to place the layers in even numbers on the same situation of the second layer.

Generally, it is desired that a multi-layered hollow coil for use in a rotatable electric equipment having no iron core, be as small as possible. And, it is necessary to electrically insulate a wire and to wind the wire in order to effectively use the space and achieve a predetermined thickness of the coil. For this purpose, it is required that gaps or spaces do not occur in the coil during the winding of multi-layers.

A conventional winding method of a multi-layered hollow coil utilizes a core for the coil, a center of which has the same shape as an inner shape of the hollow coil. The core has a width which corresponds to a predetermined width of the coil between flanges which are fixed to both sides of the core. One of the flanges may be slidably mounted on the core. A wire is wound in the space of the coil width on the core to provide multi-layers from a first layer in order. In any core, in order to wind the wire on the core having fixed flanges, the first layer of the wire is wound from a corner between an inner face of one of the flanges and an axle portion of the core in accordance with a fixed pitch through a wire guide, and when a last winding of the first layer reaches the other flange at the other side, a second or next layer layer is wound. At this time, when the wire is wound a corresponding number of times (a predetermined number) as the first layer, the wire of the second layer is spirally wound between the crests of the wire of the first layer with a reversed direction pitch as compared to the first layer. If the wire of the first layer reaches the opposite flange prior to completing the predetermined number of windings, namely, if the wire of the first layer is wound at broader intervals than the predetermined regular intervals, a wire guide is not reversed because the wire has not completed winding the predetermined number, and a first wire portion of the second layer is wound one above the other on the crest of the last winding of the first layer because the wire of the second layer is prevented or blocked by the flange.

Subsequently, after completion of the predetermined number of windings, the wire guide changes its pitch to a winding start portion of a next winding direction. Occasionally this stage, the wire in the second layer is not precisely wound between the crests of the first layer, and the wire for the second layer jumps over the crest adjacent to the last two crests and starts winding of the second layer on the next crest to turn back to the first portion of the first layer.

The portion which the wire jumped over in the second layer will be the cause of a further jumping in windings of a third and continuous layers and many gaps occur at the jumping portions in a coil, therefore, the space of the thickness of the coil is not effectively used, and the shape of the coil eventually becomes uneven.

From our experience, it is found that when the first winding portion of the first layer at a flange and the last winding portion of the first layer at the other flange, after winding a predetermined number times and which corresponds to a portion of the wire that is moved to the second layer, are placed at corresponding opposite places proximate the inner walls of the flanges and when the winding is shifted to the second layer, the shifted wire is exactly wound between the crests of the windings of the first layer. And, when the winding of the second layer is shifted to a third layer, the wire is exactly wound between the crests of the windings of the second layer, and the subsequent layers after a fourth layer are exactly wound between the crests of the windings of a lower layer.

But, an insulated wire having an uneven cross section (due to) an accidental error in formation of the diameter thereof), after being wound a predetermined number of turns to achieve a predetermined thickness for the coil, does not have a first winding portion of the first layer correspond to the last end winding portion of the first layer such that the end portions are not always positioned at the opposite portions of the inner walls of the flanges since both end flanges are fixed at a predetermined thickness or width of the coil.

Therefore, excess windings of the wire is heaped up on the last winding of the first layer, because the winding of the first layer does not achieve the predetermined number turns and the excess winding of the wire shifts to the second layer. Accordingly, a wire guide changes its pitch to start winding the wire to an opposite direction after the predetermined number of windings for the first layer, but the wire of the second layer is not placed between the crests of the wire of the first layer, and the wire jumps the next crest or crests and is inadvertently wound between unexpected crests of the lower layer and is wound to the first winding direction of the lower layer. For reasons, a wire guide guides the wire on a core of the coil in accordance with a predetermined pitch and the wire guide does not change the direction of the pitch, as compared to the first winding direction of the presently wound layer, until a predetermined number of windings are placed on the core even though the last winding of the first layer reaches the inner wall of the opposite flange along the thickness (width) of the coil between both flanges of the core, and the next winding is heaped up the first layer adjacent the fixed flange, and the predetermined number of wire windings is not able to be accommodated in the space which corresponds to the expected thickness of the coil. Under these circumstances, it is difficult to wind a wire with multi-layers between the crests of windings in manufacturing a coil of the multi-layers of the wire which do not have an even cross section and an uniform diameter such as a fusion wire.

Therefore, in a conventional winding method and apparatus for manufacturing a multi-layer hollow coil, first and second layers are wound on a core of coil which has flanges at both ends through a flier. And, after winding the second layer, once the winding through the flier is stopped and the core is reversely rotated against the direction of rotation of the flier during stopping the flier, and a wire extended to an opposite side of the flier is wound on the core adjacent the first and second layers and subsequently the wire is wound to upper layers in order. But, in the conventional method and apparatus, the strain of one twist of the wire occurs per one rotation of the flier, because the wire is wound due to rotation around the core by the flier. And, during winding the wire on the core of the coil, it is difficult to correctly spirally wind the wire on the lower layer due to the strain caused on the wire with twist of each rotation. Therefore, jumped windings easily occur in the conventional multi-layers and accordingly there is a disadvantage that the balanced torque occurred on a rotatable electric machine is not expected.

Further, in a conventional method, a wire, which is appropriately extended, is wound from the extended portion a predetermined number at a first side, and after winding the first layer at the first side the wire is shifted for a second layer at the first side and a flier is displaced to the opposite direction of the lower layer to wind the second layer. After winding the second layer, the rotation of the flier is once stopped and the core is reversely rotated against rotation of the flier due to the wire which is extended to other direction at the first winding portion of the first layer. After winding the first and second layers at a second side, the rotation of the core is stopped. Subsequently, again the flier is rotated and the third and fourth layers at the first side are wounded. And again the flier is stopped and the core is reversely rotated against the flier and the third and fourth layers at the second side are wound. In the same manner, continuous layers at the first and second sides are alternatively wound. Therefore, there are many stops for the winding machine during winding processes in the conventional method. Accordingly, it is obliged to provide and combine mechanisms for reducing the speed and for stopping the machine, and it is difficult to increase number of rotations of the core due to continuous operation of the respective steps of winding the wire, and it is difficult to efficiently operate the steps.

In the above-stated conventional method, turnings of the layer of the multi-layers are based on the adjacent wall portion of the wound wire and moves to higher layer, and the windings are reciprocally turned to the opposite directions upon the lower layer, because both flanges of the core are fixed or a slidable flange of the core is fixed during winding the wire. Therefore, each winding of the each layer is not correctly placed between the crests of the windings of the lower layer and is jumped. Accordingly, gaps in the coil occur and the ratio in windings of the wire in the predetermined width of the coil falls.

SUMMARY OF THE INVENTION

The present invention provides an improvement of a multi-layered hollow coil of a self-melting wire, and an apparatus and method of manufacturing thereof due to using a meltable wire.

A coil of the present invention, as shown in FIGS. 4 and 5, is that a wire which is appropriately drawn is wound from an intermediate portion on a coil matrix, and without the outer layer, layers in odd numbers are wound N times respectively, and layers in even numbers are wound N−1 times for winding a first portion of the coil by the wire of the wire source. And after winding the first portion, the above stated drawn wire is wound at a second portion which is adjacent to a starting side of the first portion on the matrix. After winding of the first and second portions of the coil, both winding portions are melted to form an united coil, and both ends of the wire of the first and second portions are able to draw out at the outer layer.

A method of winding a wire of the present invention, as shown in FIGS. 1, 2 and 3, is that an appropriate length of the wire for winding a second portion of a coil is wound on a winding roller of the accumulating wire prior to winding a first portion of the coil. And an intermediate portion of the wire is set at an appropriate start point for start of winding on a coil matrix, and the wire is wound the predetermined number of times due to the wire from the wire source in accordance with rotation of the matrix to form the first portion of the coil. After winding the first portion of the coil, the first portion is pressed by a second axle during melting thereof by heating. After melting the first portion, the matrix is slid in an axial direction and an aperture which is larger than a diameter of the wire is provided between a winding starting side surface and an flange placed adjacent to the side surface. Then, the coil matrix is reversely rotated against the rotating direction of winding the first portion of the coil, and the wire accumulated on the winding roller is wound in the aperture by which the second portion of the coil is formed. And the second portion of the coil is heated and united to the first portion due to melting process.

An apparatus for winding a wire of the present invention, as shown in FIGS. 6 to 10, has a reversibly rotatable main axle which is connected to a main driving motor, and a second axle which has a pressing member at an end and is supported on the same axis of the main axle and is rotated in correspondance with the rotation of the main axle, a winding roller of accumulating wire which accumulates a drawn wire to an intermediate portion of which is mounted on the predetermined portion of the matrix, guide members of the wire from the wire source to the matrix to draw the wire which is extended to the accumulated wire, pressing and melting means for pressing axially a first portion of the coil by the second axle and melting the first portion by heating after winding the first portion due to the wire from the wire source by rotation of the matrix in accordance with rotation of the main axle, means for providing an aperture between a winding starting side surface and an flange placed adjacent to the side surface due to movement of the matrix, means for winding spirally a wire to form a second portion of the coil adjacent to the side surface of the first portion of the coil due to the accumulated wire, and means for melting and uniting the second portion of the coil to the first portion after winding the second portion.

Accordingly, an object of the present invention is to provide a new multi-layered hollow coil, an apparatus and method of manufacturing thereof which overcomes the above disadvantage of the conventional coil and the apparatus and method of manufacturing thereof and which exhibit efficiently functions of the coil.

Another object of the present invention is to provide a multi-layered hollow coil which is comprised by a first portion and a second portion which are respectively wound and have not any gaps therebetween and are melted to a united body and both ends of the wire of the first and second portions are drawn to an outer layer.

Other objects and many of the attendant advantages of this invention will be readily appreciated as the same becomes better understood by reference to the following description.

BRIEF DESCRIPTION OF THE DRAWINGS

The accompanying drawings illustrate the preferred embodiment of the present invention. In the drawings, the same reference numerals illustrate the same parts of the invention, in which.

THE DETAILED DESCRIPTION OF THE INVENTION

Figure 6:
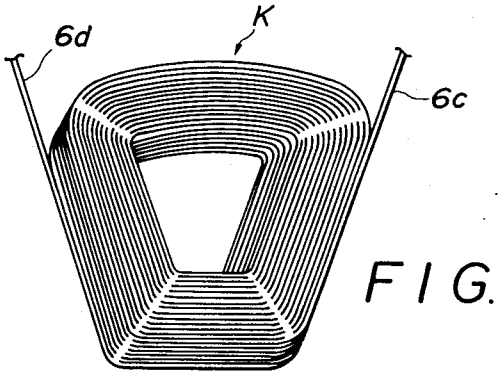
FIG. 6 is a perspective view of a multi-layered hollow coil of the present invention.

Referring to the drawings, there is shown according to a preferred embodiment of the invention as shown in FIGS. 7 to 10. A main axle 2 is mounted on a main driving motor 1 through a driving axle 31 of motor 1 to reversibly rotate. A second axle 3 is disposed on a same axis of the main axle 2 at a adjacent portion of a head of the main axle 2. The second axle 3 is rotated by the main axle 2 through a transmission axle 4. A self-melting wire 6 is wound on a coil matrix 5 in cooperation with both the main axle 2 and the second axle 3 to form a coil K (FIG. 6) which is comprised by a first wound portion 5*a* (FIG. 4) by a first winding operation and a second wound portion 5*b* by a second winding operation.

In detail, the main axle 2 is reversibly rotated by the reversible main driving motor 1 which has a speed reducer. The main axle 2 has a cylinder 8 which has a spring 7 at a head end portion. The coil matrix 5 is mounted at an end of a piston 10 of a piston rod 9 which is disposed to the main axle 2. A cylinder head cover 14 which has a hole 11 for adapting the coil matrix 5, a groove 12 provided at an outer end portion for drawing the wire 6, and a flange 13 at a drawing side of the coil matrix 5 is provided at an opening of the head end portion of the cylinder 8. The coil matrix 5 is inserted in the hole 11 and is projected from an end surface of the flange 13. The piston 10 is always pushed to the cylinder head cover 14 by the spring 7. An oil or air pressure apparatus is provided adjacent to the cylinder 8 which is connected to a path of the oil or air pressure apparatus through a connecting opening 15. A control valve or an operation valve is disposed in the path 16. The control valve is controlled to open or close in accordance with a predetermined operation program and urges the piston 10 to reciprocally move or to stop. In accordance with the operation of the piston 10, the coil matrix 5 is controlled the projection from the end surface of the flange 13, and the coil matrix 5 is slided inward from the end surface of the flange 13 as occasion demands. When the coil matrix 5 is slid inward, the coil K is united as one body after winding the wire is removed.

A thrust rod 17 is mounted on a peripheral surface of the cylinder 8, and a cylindrical member 19 is disposed to the thrust rod 17 through a thrust needle bearings 18 to slide the cylindrical member 19 along the thrust rod 17. A peripheral wall member of the cyrindrical member 19 is removably connected to a peripheral portion of the cylinder head cover 14 through a head clutch 20, and the cylindrical member 19 is rotated in accordance with rotation of the main axle 2. Winding rollers $R_1$ and $R_2$, which have respectively pawl clutches 21 and 21' and dog clutches 22 and 22' at opposite longitudinal portions of an outer surface of the cylindrical member 19, are oppositely mounted on a peripheral portion of the cylindrical member 19. On the peripheral surface of the cylindrical member 19 and between the winding rollers $R_1$ and $R_2$, jigs 23 and 23*a* (FIG. 8) are oppositely mounted to control the rotation of the main axle 2.

A [ -shaped supporting plate 24 is disposed at an upper central portion of the axle 2, and a cylinder 26 for driving the cylindrical member 19 is mounted on the supporting plate 24 through cylinder supporting members 25. An intermediate portion of a pair of levers 27 are respectively pivotably connected to an end portion of the supporting plate 24 as fulcrum, and a lower end of the each lever 27 is respectively pivotally mounted on a rear end portion of the cylindrical 19, and an upper end of the lever 27 is respectively pivotally mounted on a front portion of the cylinder 26. In accordance with driving rearward the cylinder 26, the lower end of the lever 27 is forward moved and the cylinder 19 is forward slided predetermined distance as the lever 27 is pivotally moved on the front end of the supporting plate 24 which operates as a fulcrum. In accordance with movement of the cylindrical member 19, both the winding rollers $R_1$ and $R_2$ are moved forward. At a lower rearward portion of the main axle 2, a cylinder 28 for control of the rotation of the main axle 2 is disposed which controls the rotation of the main axle 2 in cooperation with the jigs 23 and 23*a* which are provided on the cylindrical member 19.

Figure 10:
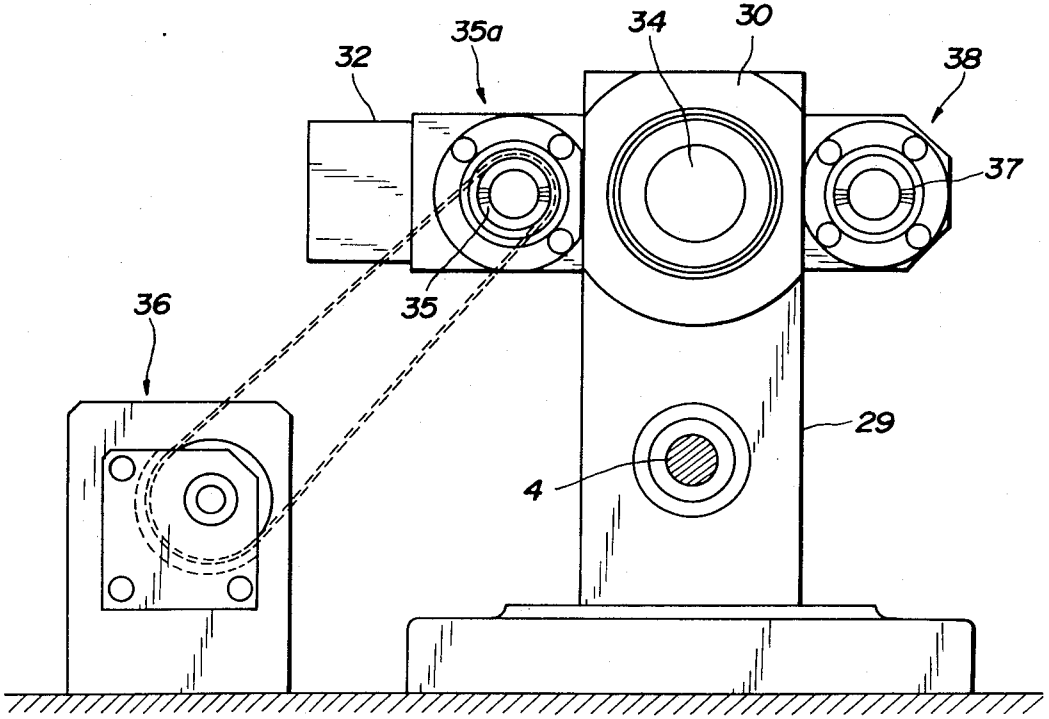
FIG. 10 is a cross sectional side view along line X—X in FIG. 8.

The second axle 3, which is oppositely adjacent to an end of the main axle 2, is mounted on rod supporting members 30, 30*a* which is provided on an appropriate base frame 29. The second axle 3 is reversibly synchronously rotated with the main axle 2 through the transmission axle 4 by the main driving motor 1 as shown in FIGS. 7, 8 and 10.

Figure 3:
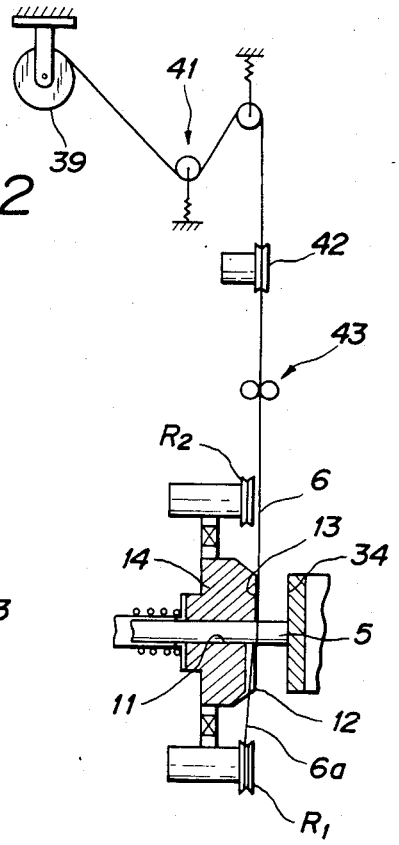
FIG. 3 is a diagrammatic theoretical explanation side view of a wire winding mechanism showing a manner of running the wire from a wire source to the coil matrix and coil accumulated roller.
Figure 5:
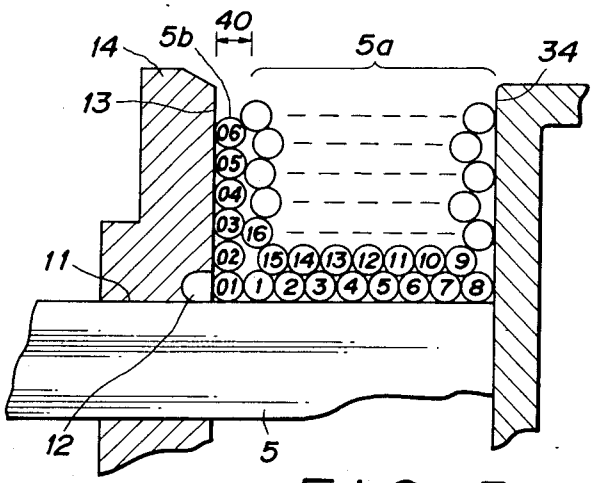
FIG. 5 is a diagrammatic theoretical explanation side view showing a condition of winding a second portion of the coil adjacent to the first portion of the coil between the flanges on the coil matrix.
Figure 7:
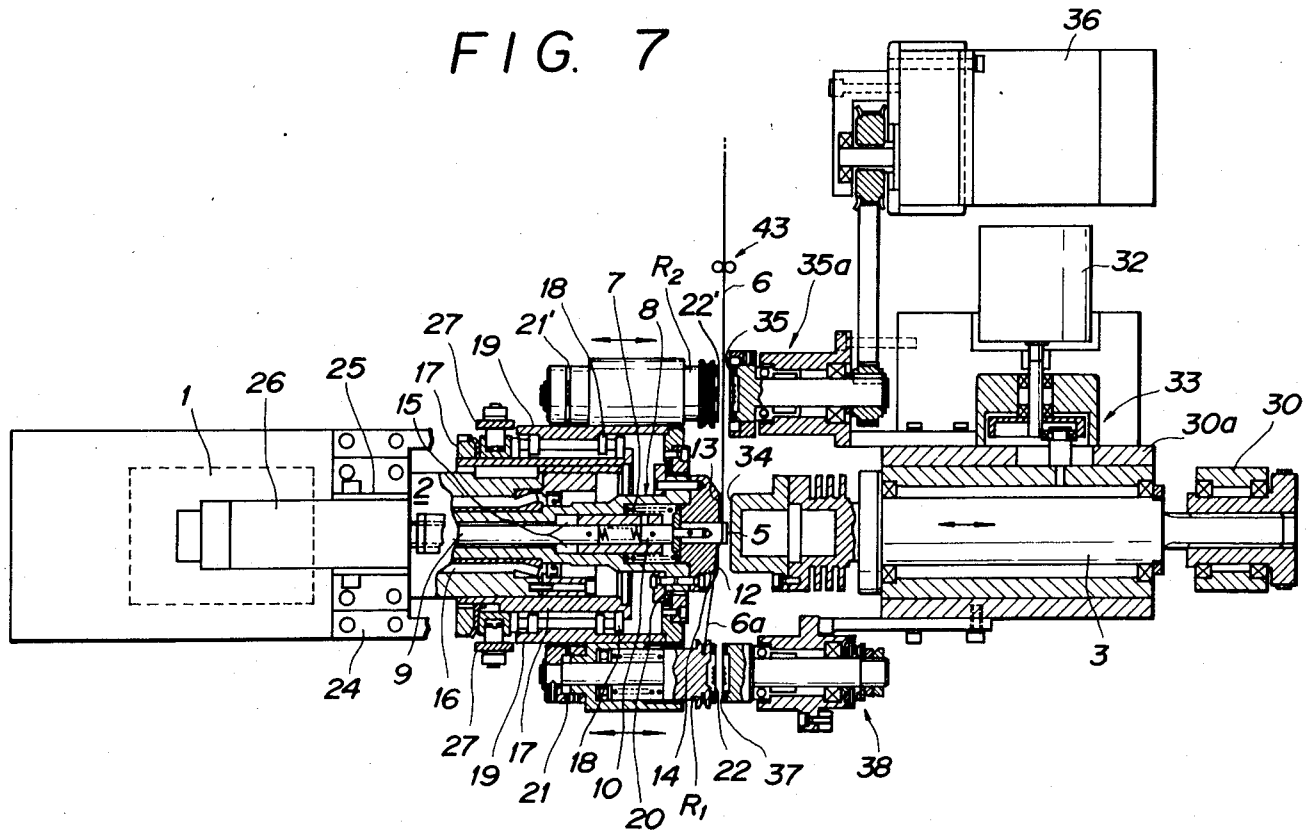
FIG. 7 is a partially cross-sectional plan view of a winding apparatus of the present invention.
Figure 8:
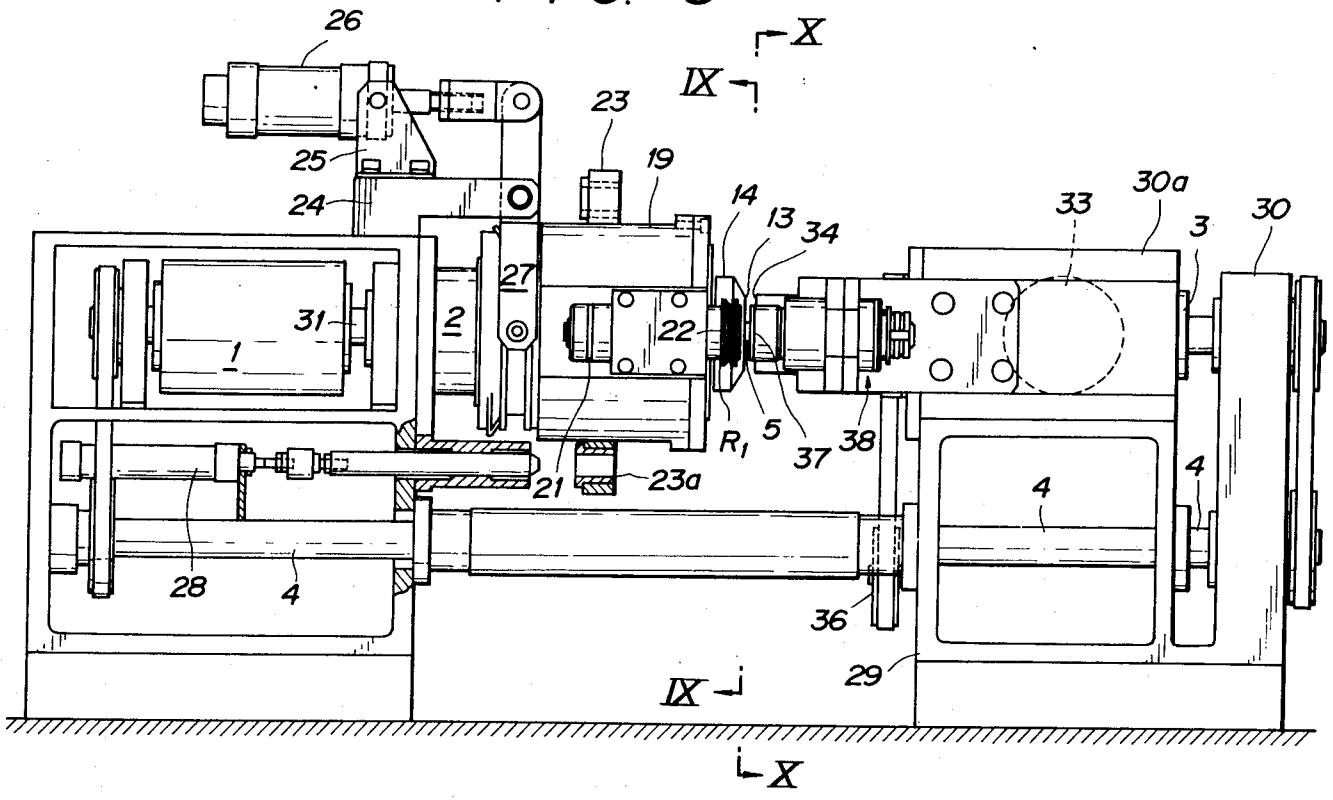
FIG. 8 is a side view of the winding apparatus shown in FIG. 7.
Figure 9:
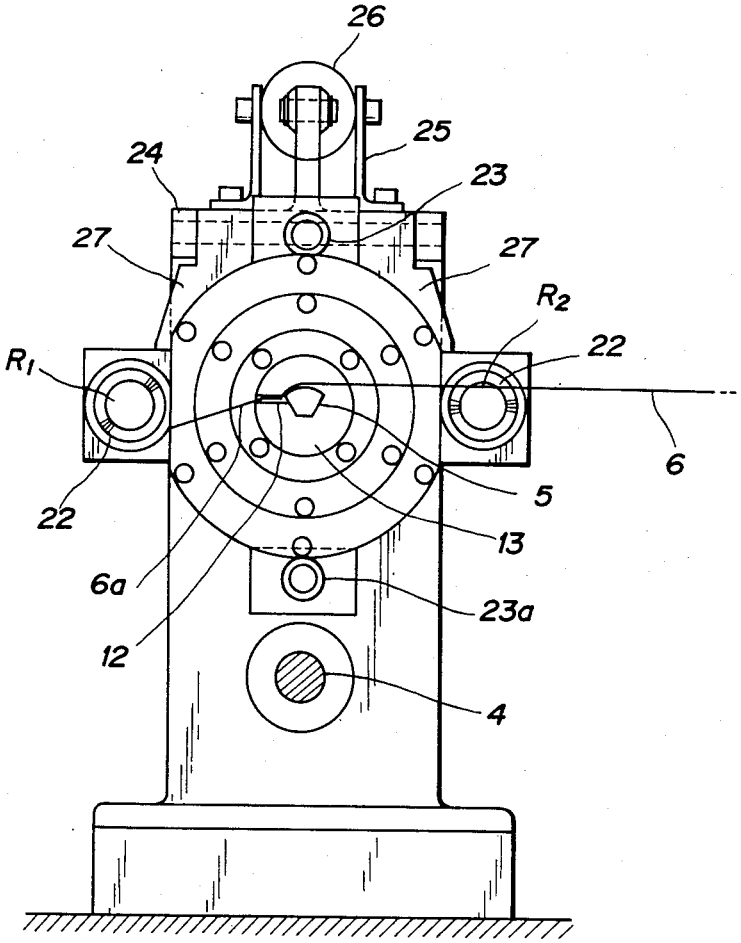
FIG. 9 is a cross-sectional side view along line IX—IX in FIG. 8.

And the second axle 3 is disposed to move a direction of the main axle 2 by a cam structure for controlling the pushing force which is driven by a stepping motor 32 which is mounted on the base frame 29 as shown in FIG. 7. A push apparatus which has a flange 34 is connected on a front end of the second axle 3 adjacent to the end of the cylinder head cover of the main axle 2. An end surface of the flange 34 is releasably contacted to an end surface of the coil matrix 5 which is projected from an outer surface, namely a flange 13 of the cylinder head cover 14 of the main axle 2. The flange 34 controls the ratio of projection of the coil matrix 5 when the wire 6 is wound on the coil matrix, and the flange 34 pushes the first wound portion 5*a* on the coil matrix 5 to the direction of the main axle 2 to form a predetermined width of the coil when the first wound portion 5*a* is melted due to heating after winding the wire 6 on the coil matrix. A driving apparatus 35*a* which has a clutch 35 for accumulating the wire 6 on the winding roller $R_2$ is concentrically disposed apart from the second axle 3 and to oppose the winding roller $R_2$ which is mounted on a side of the cylindrical member 19 of the main axle 2 as shown in FIG. 7. The clutch 35 is engaged with the dog clutch 22' which is provided at end of the winding roller $R_2$, and the driving apparatus 35*a* is driven by a driving motor 36 which has an electromagnetic valve and is disposed adjacent to the second axle 3. On the other hand, a tensioner apparatus 38 which has a tension clutch 37 to engage with the dog clutch 22 of the winding roller $R_1$ is disposed opposite to the driving apparatus 35 on an outer surface of the second axle 3 and at an opposite portion of the winding roller $R_1$ which is disposed at front and concentric portion of the main axle 2. The tension clutch 37 is able to engage with one of the dog clutches 22 and 22' of the winding rollers $R_1$ and $R_2$ . After winding the first portion 5*a* of the wire 6 which is drawn from a wire source 39 due to regular rotation of the coil matrix 5, the first portion 5*a* is adjusted to the predetermined width by pressing the first portion 5*a* by the flange 34 of the second axle 3 during melting operation of the first portion 5*a* by heating. After the adjustment and melting operation, the coil matrix 5 is slid together with the first portion 5*a* to the direction of the second axle 3. Prior to winding the second portion 5*b* in an aperture 40 which is provided between a starting side surface of the first portion 5*a* and a surface of the flange 13. the cylindrical member 19 is forward slided due to the cylinder 26 for driving the cylindrical member 19 which is mounted on an upper portion of the main axle 2. And, the winding roller $R_1$ and $R_2$, which are disposed at both sides of the main axle 2, are simultaneously moved forward in the direction of the second axle 3, and with regard to one winding roller $R_1$ of both the winding rollers $R_1$ and $R_2$, as shown in FIGS. 3 and 7, the dog clutch 22 of the winding roller R' is engaged with the tensioner clutch 37 of the tensioner apparatus 38. Due to the engagement, a wire 6*a* which is accumulated on the winding roller $R_1$ is tensioned, and at this time the main axle 2 is reversely rotated against the direction of winding the first wound portion 5*a*, and the wire which is accumulated on the winding roller $R_1$ is spirally wound in the aperture 40 (FIG. 5) between the starting side surface of the first wound portion 5*a* and the surface of the flange 13.

In correspondence to winding the second portion 5*b*, the dog clutch 22' of the winding roller $R_2$ is engaged with the clutch 35 of the driving apparatus 35*a*, and a wire 6 from the wire source 39 is wound and accumulated on the winding roller $R_2$ due to driving of the driving motor 36 for accumulating the wire.

As stated above, the accumulated wire 6*a* on the winding roller $R_1$ which is positioned at this side of the main axle 2 is wound as the second wound portion 5*b* which is wound adjacent to the first wound portion 5*a* on the same coil matrix 5, and simultaneously, the winding roller $R_2$ of the main axle 2 winds and accumulates a wire for winding a next second portion 5*b* of a subsequent cycle of winding the coil K. After winding the wire, the main axle 2 is turned from side to side together with both the winding rollers $R_1$ and $R_2$ and the wire 6 is moved to the condition shown in FIG. 2 from the former condition shown in FIG. 1. In the specification, the accumulated wire on one of the rollers $R_1$ and $R_2$ is called as the wire 6*a*.

The winding roller $R_2$ which accumulated the wire 6*a* for a next cycle of winding a coil is changed its position to other winding roller $R_1$ which does not accumulate the wire. An intermediate portion of the wire 6*a* which is accumulated on the winding roller $R_1$ and is set in the groove 12 for drawing the wire of the coil matrix 5, and the first wound portion 5*a* of the next cycle is wound by the wire 6 which is drawn out to an opposite side of the winding roller $R_2$ from the wire source 39. The winding steps are repeated in order for continuous manufacture of the coils K.

An operation of the apparatus and method of the present invention is explained in detail in accordance with the drawings.

Figure 1:
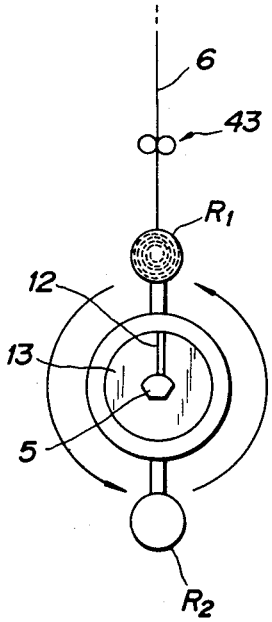
FIG. 1 is a diagrammatic theoretical explanation view showing a condition of an accumulated wire on a winding roller disposed around a coil matrix and a manner of moving the wire accumulated roller of the present invention.
Figure 2:
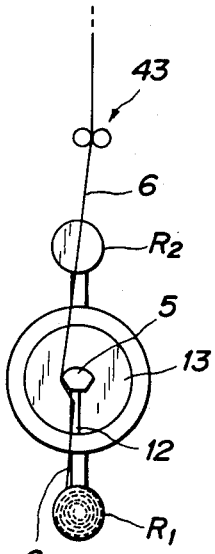
FIG. 2 is a diagramatic theoretical explanation view showing a manner of setting the wire on the coil matrix and a condition of resetting the coil accumulated roller.

The wire 6 which is drawn out from the wire source 39 is appropriately tensioned by a tensioner 41 which is provided between the wire source 39 and the coil matrix 5 as shown in FIGS. 1, 2 and 3, and runs through a sensor 42 for detecting the volume of the accumulated wire to a transverser 44. And, predetermined volume or length of the wire 6 which is set in the sensor 42 for detecting the volume of the accumulated wire is accumulated on the roller $R_1$ which is engaged with the clutch 35 due to rotation of the roller $R_1$ by rotation of the driving motor 36 prior to turn of the winding rollers $R_1$ and $R_2$ shown by arrow heads in FIG. 1. After accumulation of the wire on the winding roller $R_1$, the winding roller $R_1$ and $R_2$ are turned as shown by the arrow heads in FIG. 1 and both the winding rollers are positioned as shown in FIG. 2. And, an intermediate portion of the wire 6*a* which is accumulated on the winding roller $R_1$ is set in the groove 12 of the coil matrix 5, and the wire 6 which is continuously drawn out from the wire source 39 is wound on the coil matrix 5 to wind up the first wound portion 5*a* due to rotation of the main axle 2.

An intermediate appropriate portion of the wire 6*a* which is accumulated on the winding roller $R_1$ and is drawn out therefrom is inserted in the groove 12 for winding the wire and set on the coil matrix 5 as a starting portion of the first wound coil 5*a*. And, upon arrangement of the wire 6 which is drawn from the wire source 39 to wind on the coil matrix 5, the main driving motor 1 and the main axle 2 with the coil matrix 5 are rotated to one direction and the wire 6 from the wire source 39 is wound on the coil matrix 5 to form the first wound portion 5*a* of the coil K.

Prior to winding operation of a winding apparatus of the present invention, simultaneously with setting the wire 6 on the coil matrix 5, the aperture between the flanges 13 and 34 is provided in relation to the width of the coil to be wider about from 20% to 50% of the diameter of the wire 6 than the contemplated coil width due to operation of the cylinder 8 which is disposed in the head of the main axle. The coil matrix 5 is projected from the end surface of the flange 13 to contact a tip portion of the coil matrix 5 to the end surface of other flange 34, and the position of the end surface of the flange 34 is temporally positioned and the degree of projection of the coil matrix 5 is decided. And subsequently, the apparatus of winding the wire is driven.

Figure 4:
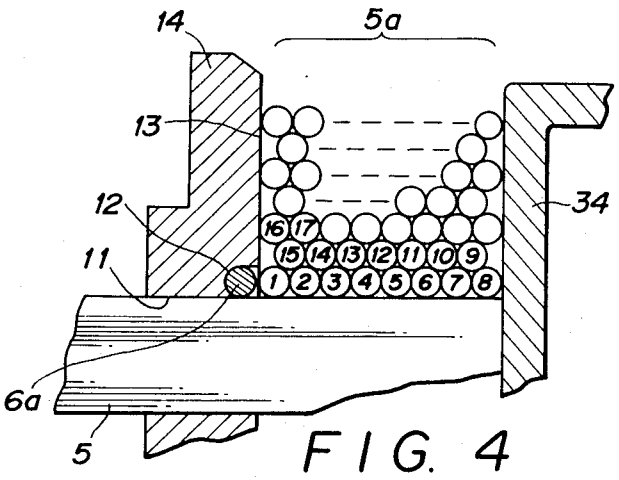
FIG. 4 is a diagrammatic theoretical explanation side view showing a condition of winding a first portion of a coil between flanges on the coil matrix.

In other words, after preparation for winding the wire 6 from the wire source on the coil matrix 5, when the main axle 2 and the second axle 3 are simultaneously regularly rotated due to the reversible main driving motor 1, the winding roller $R_1$ which accumulated the wire 6*a* is moved together with the main axle 2 at the same position in relation to the main axle 2. On the other hand, due to the wire 6 from the wire source 39, a first layer of the wire 6 on the coil matrix 5 is wound as shown in FIG. 4. With regard to the first layer of the wire 6, when the wire 6 is wound N times such a number of times 1, 2, 3, 4, 5, 6, 7 and 8, the wire 6 is contacted to a portion of the end surface of the flange 34 corresponding to the portion of the end surface of the flange 13. And the wire 6 is moved to an upper portion for a second layer, and the traverser 43 changes the pitch to the direction of the flange 13 of the winding starting portion. Due to the continuous regular rotation of the coil matrix 5, the wire 6 of the second layer is regularly wound N−1 times between the crests of the windings of the wire of the first layer such a number of times 9, 10, 11, 12, 13, 14 and 15 and the winding of the second layer is completed. Subsequently, the wire 6 is moved to further upper portion for a third layer and is wound N times as the same manner as the first layer between the crests of the windings of the wire of the second layer. A fourth layer is wound N−1 times on the third layer between the crests of the windings of the third layer. After winding the fourth layer, the wire 6 is moved to a fifth layer, and further layers are wound as the same manner, for example, without the outer layer, layers in odd numbers are wound N times respectively, and layers in even numbers are wound N−1 times for winding the first wound portion 5*a* for a first winding operation. With regard to situation of the windings to each other, the wire 6 which is wound adjacent a former winding is wound between the crests of the windings of the lower layer each other, and the end of the wire 6 after the winding operation is extended to out of the outer layer as a leading wire 6*c*.

After the first winding operation for forming the first wound portion 5*a*, the second axle 3 is moved to the direction of the main axle 2 through the cam structure 33 for controlling the pushing force due to driving the stepping motor 32 and the flange 34 presses consequently the first wound portion 5*a* to other flange 13, and the first wound portion 5*a* of the coil is simultaneously electrically heated at the appropriate voltage. At this stage, the flange 34 press the first wound portion 5*a* of the coil to have the predetermined width between the both flanges and the first wound portion 5*a* is melt to unite as a one body.

Subsequently, the aperture 40 which corresponds to at least the diameter of the wire 6 is provided between the flange 13 and the starting side surface of the first wound portion 5*a* of the coil. And, the main axle 2 is reversely rotated due to the reversible main driving motor 1, and the wire 6*a* which is accumulated on the winding roller $R_1$ is wound in the aperture 40 adjacent the starting side surface of the first wound portion 5*a* to form a spirally wound second portion 5*b* of the coil. The end of the wire 6*a* after the second winding operation is extended to out of the outer layer as a leading wire 6*d*.

The second wound portion 5*b* of the coil is heated and melt with the first wound portion 5*a*. After uniting the first and second portions 5*a* and 5*b*, the piston 10 of the cylinder 8 of the main axle 2 is moved backward and therefore the coil matrix 5 is moved backward to the direction of the cylinder 8 from the end surface of the flange 13, and the completed coil K which is melt as one body is removed from the coil matrix 5.

After first accumulating the wire 6*a* on the winding roller $R_1$ from the wire source 39 and first setting the wire on the coil matrix 5, above disclosed winding apparatus is able to be continuously driven for an automatic winding operation with a computer that has a program setting the order of winding steps and the winding time.

EFFECTS OF THE INVENTION

The present invention which has the above disclosed structure has following effects.

Both the flanges 13 and 34 are not fixed on the coil matrix 5, but movably supported, and select appropriately the required width of the coil K. And, the windings of one layer which consists of predetermined windings do not overlap between both the flanges, because the aperture between both the flanges is provided about from 20% to 50% of the diameter of the wire 6 wider than the coil width where the flange 34 is temporarily set, and a lower layer is certainly wound the predetermined times in the slightly wide aperture and an upper layer is certainly wound between the crests of the lower layer, and at the end of the lower layer, the next winding of the wire changes to the upper layer at the portion that the first winding of the first layer is started. Since the first layer is correctly wound N times, the second layer is certainly wound N−1 times, therefore adjacent layers are correctly wound between the crests of the respectively lower layer, and the wire does not jump to an unexpected portion.

Accordingly, unexpected gaps or space do not occur, and it is expected to make a balanced torque of the coil, to increase the effective area and the torque of the coil. The shape of the coil is able to be balanced, and it is able to improve condition of combination with an apparatus to which the coil is disposed, because the wire is wound at an intermediate portion, and the first and second wound portions are respectively separately formed and are pressingly adjusted into shape when both the portions are melted into one body, moreover, both ends of the wire are drawn out from the outer layer.

Moreover, the winding apparatus of the present invention increases the efficiency of operations because the stopping time during the winding operation is short and the winding step is programmed. And the wire wound for the layers is not twisted during the winding operation because the coil matrix is always rotated, and the wire is correctly wound because the width between the flanges 13 and 34 is certainly adjusted. Further, the width of the completed coil K is equalized as required due to pressing and uniting the coil during the melting operation.

The invention may be embodied in other specific form without departing from its spirit or essential characteristics. The described embodiment is to be considered in all respect only as illustrative and not limiting and the scope of the invention is, therefore, indicated by the appendant claims rather than by the forcegoing description. All changes which come within the meanings and range of equivalency of the claims are to be amended within their scope. Consequently, it is recognized many variations may be made within departing from the scope or spirit of the present invention.

What is claimed is:

1. A multi-layered hollow coil of a self melting wire comprising:

a first wound portion wound on a coil matrix from an intermediate portion of the wire extending from a wire source, and including layers of odd numbers wound N times and other layers of even numbers wound N-1 times except an outer layer;

said first wound portion pressed and melted into one body;

a second wound portion of wire wound spirally adjacent to a first side surface of the first wound portion, using wire accumulated on a winding, on the coil matrix due to reverse rotation of the coil matrix;

said second wound portion pressed and melted into one body with the first wound portion and removed from the coil matrix; and both ends of the wire drawn out from the outer layer.

2. A multi-layered hollow coil to claim 1, wherein the first wound portion and the second wound portion are formed the predetermined thickness of multiple of a diameter of the wire, and the layers except the first layer are wound between crests of windings of a lower layer.

3. A method of manufacturing a multi-layered hollow coil from a self-melting wire, comprising the steps of:

accumulating a wire of the predetermined length for winding a second wound portion on a winding roller;

turning the wire accumulated roller to an opposite side and setting an intermediate portion of the wire extending from a wire source on a coil matrix;

winding the wire drawn out from the wire source the predetermined times to form multi-layers of a first wound portion on the coil matrix due to rotation of the coil matrix;

pressing the first wound portion after winding up the multi-layers between flanges by movement of one of the flanges mounted on a movable axle, and melting the first wound portion during pressing step thereof;

providing an appropriate aperture being as wide as at least a diameter of the wire between the flange and a first side surface of the first wound portion due to movement of the coil matrix axially after melting the first wound portion;

winding spirally a second wound portion, in the aperture adjacent the first side surface of the first wound portion, with the accumulated wire on the winding roller by reverse rotation of the coil matrix;

pressing and melting the second wound portion after winding up thereof to unite with the first wound portion; and removing the united and formed multi-layered hollow coil from the coil matrix due to drawing in the coil matrix.

4. An apparatus for manufacturing a multi-layered hollow coil comprising:

a reversible driving motor;

a main axle disposed on the reversible driving motor;

a second axle disposed on the same axis of the main axle and being synchronously rotatable with rotation of the main axle;

a coil matrix slidably mounted on the main axle;

means for accumulating a wire on at least one winding roller disposed on an appropriate support portion being turnable to an opposite side in relation to the coil matrix, said wire being drawn out from a wire source and being accumulated to an intermediate portion thereof;

means for drawing out the wire from the wire source to the coil matrix;

means for rotating the coil matrix due to rotation of the main axle and controlling the rotation of the coil matrix to wind the wire for forming a first wound portion of multi-layers of windings of the wire on the coil matrix;

a pair of flanges disposed beside the coil matrix to set a predetermined width of the coil;

means for melting the first wound portion on the coil matrix during pressing thereof between the flanges;

means for providing a predetermined aperture between the flange and a first side surface of the first wound portion;

means for winding spirally a second wound portion with the accumulated wire in the aperture adjacent to the first side surface of the first wound portion by reverse rotation of the coil matrix;

means for melting the second wound portion on the coil matrix to unite with the first wound portion; and means for removing the multi-layered hollow coil from the coil matrix.

5. An apparatus for munufacturing a multi-layered hollow coil to claim 4, wherein one of the flanges is a cylinder head cover provided at an end of the main axle, and the other of the flanges is mounted on an end of the axially movable second axle.

6. An apparatus for manufacturing a multi-layered hollow coil to claim 4, wherein a pair of winding rollers which have respectively clutch apparatus are provided on a cylindrical member supported around the main axle through thrust needle bearings.

7. An apparatus for manufacturing a multi-layered hollow coil to claim 4, wherein clutch apparatus are provided in relation to the second axle and are opposited to the clutch apparatus of the winding rollers.

8. An apparatus for manufacturing a multi-layered hollow coil to claim 4, wherein the second axle includes a driving motor and a cam structure for controlling pushing force of the flange which is opposited to the end of the coil matrix.

* * * * *